US007067770B1

(12) United States Patent
Volk et al.

(10) Patent No.: US 7,067,770 B1
(45) Date of Patent: Jun. 27, 2006

(54) RADIANT HEATING SYSTEM WITH A HIGH INFRARED RADIANT HEATING CAPACITY, FOR TREATMENT CHAMBERS

(75) Inventors: Hans-Peter Volk, Griesingen (DE); Johann George Reichart, Blaubeuren (DE)

(73) Assignee: Centrotherm Elektrische Anlagen GmbH & Co., Blaubeuren (DE)

( * ) Notice: Subject to any disclaimer, the term of this patent is extended or adjusted under 35 U.S.C. 154(b) by 289 days.

(21) Appl. No.: 10/129,340

(22) PCT Filed: Nov. 8, 2000

(86) PCT No.: PCT/DE00/03908

§ 371 (c)(1),
(2), (4) Date: Sep. 3, 2002

(87) PCT Pub. No.: WO01/35699

PCT Pub. Date: May 17, 2001

(30) Foreign Application Priority Data

Nov. 9, 1999 (DE) ..... 299 19 685 U

(51) Int. Cl.
*F27B 5/14* (2006.01)

(52) U.S. Cl. ..... 219/390; 219/405; 219/411; 392/416; 392/418; 118/724; 118/725; 118/50.1

(58) Field of Classification Search ..... 219/390, 219/405, 411; 392/416, 418; 118/724, 725, 118/50.1
See application file for complete search history.

(56) References Cited

U.S. PATENT DOCUMENTS

| | | | | |
|---|---|---|---|---|
| 4,101,424 | A * | 7/1978 | Schooley et al. | 250/504 R |
| 4,540,876 | A * | 9/1985 | McGinty | 219/405 |
| 5,196,674 | A | 3/1993 | Chartrain et al. | 219/411 |
| 5,551,670 | A | 9/1996 | Heath et al. | 266/87 |
| 5,951,896 | A * | 9/1999 | Mahawili | 219/411 |
| 6,600,138 | B1 * | 7/2003 | Hauf et al. | 219/411 |

FOREIGN PATENT DOCUMENTS

| | | |
|---|---|---|
| EP | 0848575 | 6/1998 |

* cited by examiner

*Primary Examiner*—Shawntina Fuqua
(74) *Attorney, Agent, or Firm*—Baker Botts L.L.P.

(57) ABSTRACT

A radiant heating arrangement with a high infrared heating capacity for treatment chambers provides a vacuum-compatible radiant heating system with which it is possible to achieve considerable radiation levels reliably. The radiant heating arrangement includes a tube that is permeable to infrared radiation. The tube extends into the treatment chamber and penetrates the wall of the chamber with at least one end. A source of infrared radiation is situated inside the tube with the inside of the tube being isolated from the atmosphere inside the treatment chamber.

4 Claims, 3 Drawing Sheets

RADIANT HEATING SYSTEM WITH A HIGH INFRARED RADIANT HEATING CAPACITY, FOR TREATMENT CHAMBERS

BACKGROUND OF THE INVENTION

The invention relates to a radiant heating system having a high infrared heating capacity for processing chambers.

Such radiant heating systems are employed for example inside of processing chambers, e.g. vacuum chambers, in order to generate a requisite working temperature in a given space. Such temperatures may easily reach 3000° C. in the emitter region, and in the case of spaces of great area, an "array" having a plurality of emitters may alternatively be used, in order to achieve a uniform working temperature over a larger space.

Such radiant heating systems, however, have been found to have some disadvantages, considerably limiting their application. First, there is the problem that, especially in vacuum applications, electrical breakdown may occur at high operating voltages. This hazard arises especially during the process of evacuation. Second, especially high working temperatures and/or radiation outputs may be unattainable in a vacuum due to lack of adequate cooling of the infrared emitters.

To avoid breakdowns, the voltage may of course be reduced, but then the requisite radiation output cannot be attained. Besides, there is the possibility that the heating of the vacuum chamber may be cut off during evacuation. But this necessarily leads to an undesirable increase, or prolongation, of processing time.

U.S. Pat. No. 5,551,670 describes a high-intensity infrared heating device in which the lifetime of the infrared emitters is to be enhanced thereby. To accomplish this, each infrared emitter is arranged in a transparent quartz tube through which cooling air can be passed. For this purpose, copper are provided extending through the electrical connection contacts of the infrared emitter. In order not to affect the efficiency of the infrared emitters adversely, the surrounding air is passed into the quartz tube only at temperatures above 1500° F. (793° C.).

Further, EP-A-0,848,575 discloses a heating device having an array of tungsten-halogen emitters, in each instance ranged in a concentric arrangement of quartz, silicon or sapphire tubes. To concentrate the radiation generated and orient it in a preferred direction, one of the tubes is provided with a reflector in the form of a gold coating partly surrounding the tube.

Finally, U.S. Pat. No. 5,196,674 describes a furnace with protection for a heating element arranged in a quartz tube. The protection here provided against contact consists in a multiply slitted U-shaped housing of sheet metal enclosing the quartz tube with clearance.

SUMMARY OF THE INVENTION

The object of the invention, then, is to create a vacuum-worthy radiant heating system in which the disadvantages exhibited by the prior art are avoided.

The object to which the invention is addressed, a radiant heating system having a high infrared radiation output, in which the infrared radiation unit consists of an infrared emission source, arranged inside a quartz glass tube transmissive to infrared radiation. The quartz glass tube is arranged to receive a flow of air. The infrared radiation source is associated with a radiation reflector and connectable to an energy source. The quartz glass tube extends into the vacuum processing chamber and penetrates its wall at least at one end. The interior of the quartz glass tube is isolated from the atmosphere inside the vacuum processing chamber, and the places where the quartz glass tube passes through the chamber wall are sealed airtight.

To achieve a uniform irradiation of a large area, an array of infrared radiation units with infrared radiation sources may be provided. Each infrared radiation source may be separately connectable to an energy source, in order to make possible a simple adaptation of the radiation output as needed, e.g. by cutting in the requisite number of infrared radiation sources from time to time.

By virtue of the invention, it becomes possible to operate the infrared radiation source at any operating voltages, that is, even at high operating voltages, without incurring the danger of electrical breakdown in the processing chamber. Furthermore, the invention permits the attainment of especially high working temperatures, or radiation outputs, since the atmosphere inside the tube is completely independent of the atmosphere inside the processing chamber.

It is advantageous for the tube to be fabricated of a highly temperature-resistant material, such as quartz glass.

A refinement of the invention provides that the places where the tube passes through the wall are sealed airtight. This has the advantage that the radiant heating means according to the invention may be employed even with an extreme atmosphere in the processing chamber.

Because the source of infrared radiation is accommodated in the tube, it is possible, in further modification of the invention, to cool the infrared source by connecting the tube to a cooling apparatus. This is especially convenient if both ends of the tube extend through the respective opposing walls of the chamber.

This may for example be accomplished by connecting the tube to a source providing a flow of air inside the tube, whereby an intensive cooling of the infrared radiation source is made possible, so that especially high infrared radiation outputs can be attained with no problems, without thereby shortening the life of the infrared radiation source.

To avoid infrared radiation in undesirable directions and enhance the radiation output towards an object to be heated, the infrared radiation source, in an embodiment of the invention, is furnished with a radiation reflector.

The radiation reflector may be arranged in the tube together with the infrared source, to avoid otherwise possible additional thermal effects in the processing chamber.

Another refinement of the invention is characterized by arranging a plurality of tubes with infrared radiation sources in an "array." In this way, it becomes possible to achieve uniform radiation over a large area.

To accomplish this, the array is arranged inside the processing chamber, with at least one end of each tube of the array passed through the wall of the chamber. In that case, of course, the end of each tube of the array that lies inside the chamber must be closed. If the tubes of the array extend through the wall of the chamber at both ends, these tubes may be connected to a cooling circuit, so that the cooling medium can flow through the tubes.

In an advantageous embodiment of the invention, each infrared radiation source is separately connectable to an energy source. In the case of arrays of large area, this permits a simple adaptation of the radiation output as needed from time to time, for example by changing the number of infrared radiation sources required in each instance.

BRIEF DESCRIPTION OF THE DRAWINGS

The invention will now be illustrated in more detail in terms of embodiments by way of example. In the figures of the accompanying drawing, various embodiments of the radiation heating system according to the invention may be seen.

DETAILED DESCRIPTION OF THE INVENTION

Figure 1:
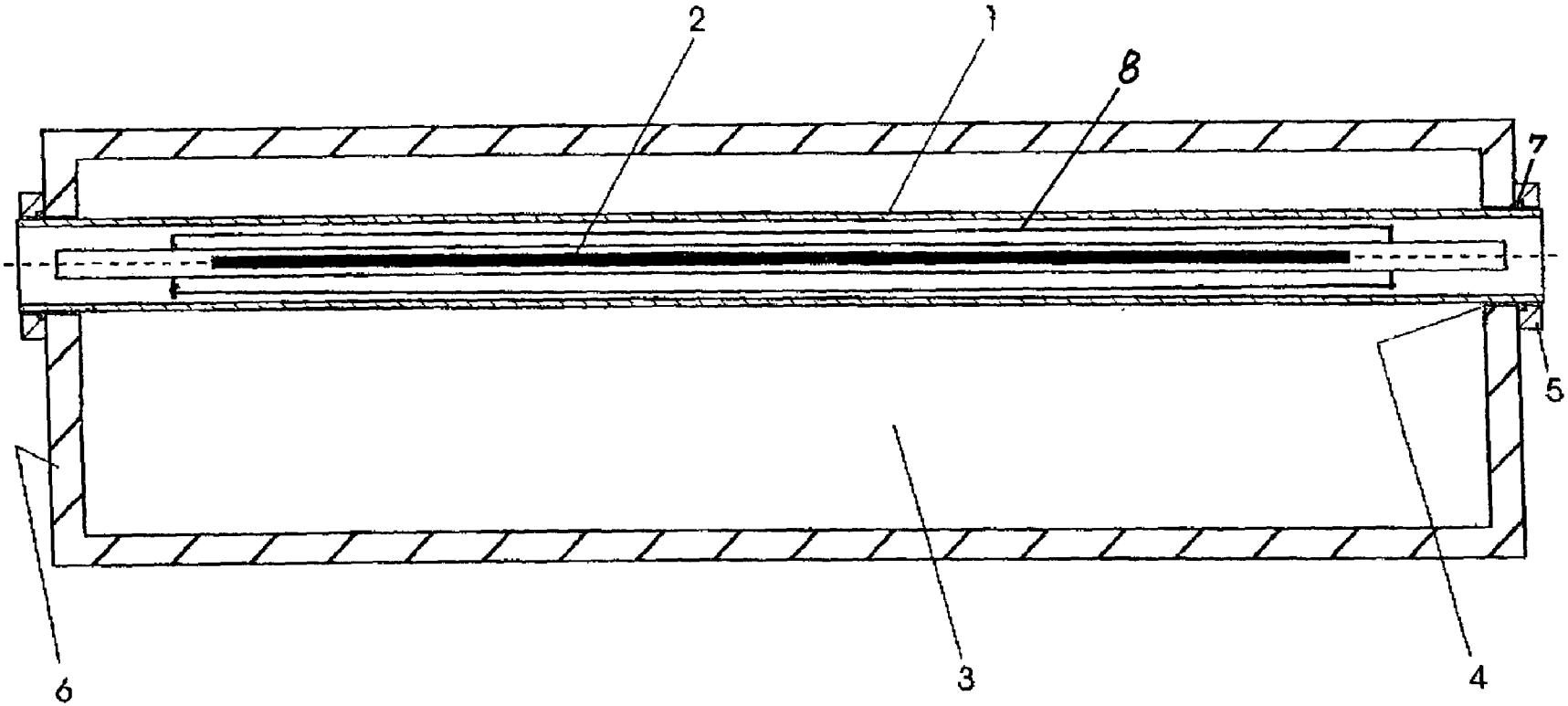
FIG. 1 shows a radiant heating system according to the invention in which the tube transmissive to the infrared radiation extends through both opposed walls of the processing chamber.

The radiation heating arrangement according to a first embodiment of the invention consists, in FIG. 1, of a tube 1 transmissive to infrared radiation, extending through a processing chamber 3 and piercing its wall 6 through an aperture 4 at each end. Inside the tube 1, an infrared radiation source 2 is arranged, isolated from the atmosphere inside the processing chamber 3. This tube 1 consists of a highly temperature-resistant material, preferably quartz glass. The tube includes an internal infrared reflector 8.

To rule out any disturbance of the atmosphere inside the processing chamber 3, the places where the tube 1 passes through the wall 6 are sealed airtight. For this purpose, a closure 5 is provided with an internal seal 7.

Further, the infrared radiation source 2 in the tube 1 is connected to a source of cooling air which is not shown. For example, the tube 1 may be connected to a unit for generating a flow of air inside the tube 1. In this way, high radiation outputs can be generated even for a long time without adversely affecting the service life of the infrared radiation source 2.

Also, it is possible without problems to equip the infrared radiation source 2 with a radiation reflector 8 in order to achieve a maximum radiation output towards a working region inside the processing chamber 3.

The radiation reflector 8 is preferably arranged together with the infrared radiation source 2 in the tube 1 to avoid undesirable thermal effects or else a contamination of the atmosphere in the processing chamber 3, which might be caused by the material of the radiation reflector.

Figure 3:
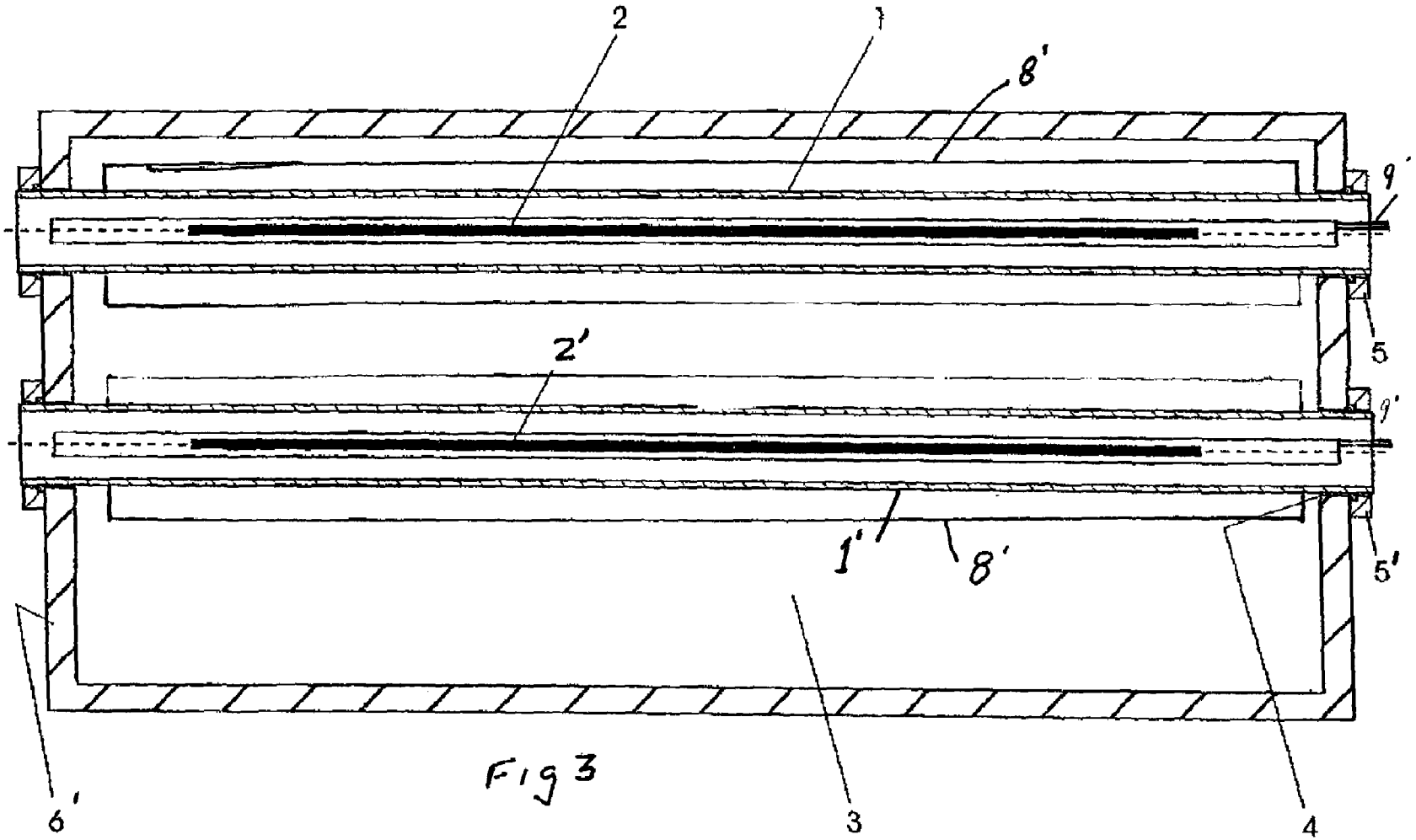
FIG. 3 shows an arrangement having a plurality of infrared radiators.

It is possible also to arrange a plurality of tubes 1', with infrared radiation sources 2, 2' in an array, the array being arranged inside the processing chamber 3, and each tube of the array being passed through the wall 6 of the processing chamber 3 at both ends as shown in FIG. 3. Each of the infrared radiation sources 2 may be separately connectable to and disconnectable from an energy source by electrical terminals 9, 9'. This will for example permit simple adaptation of the radiation output as needed from time to time. Thus, a uniform irradiation of the objects to be processed is achieved over the entire emitter area of the array. The array shown in FIG. 3 has reflectors 8, 8' located outside tubes 1, 1', but these may be within the tubes as in the FIG. 1 embodiment.

Figure 2:
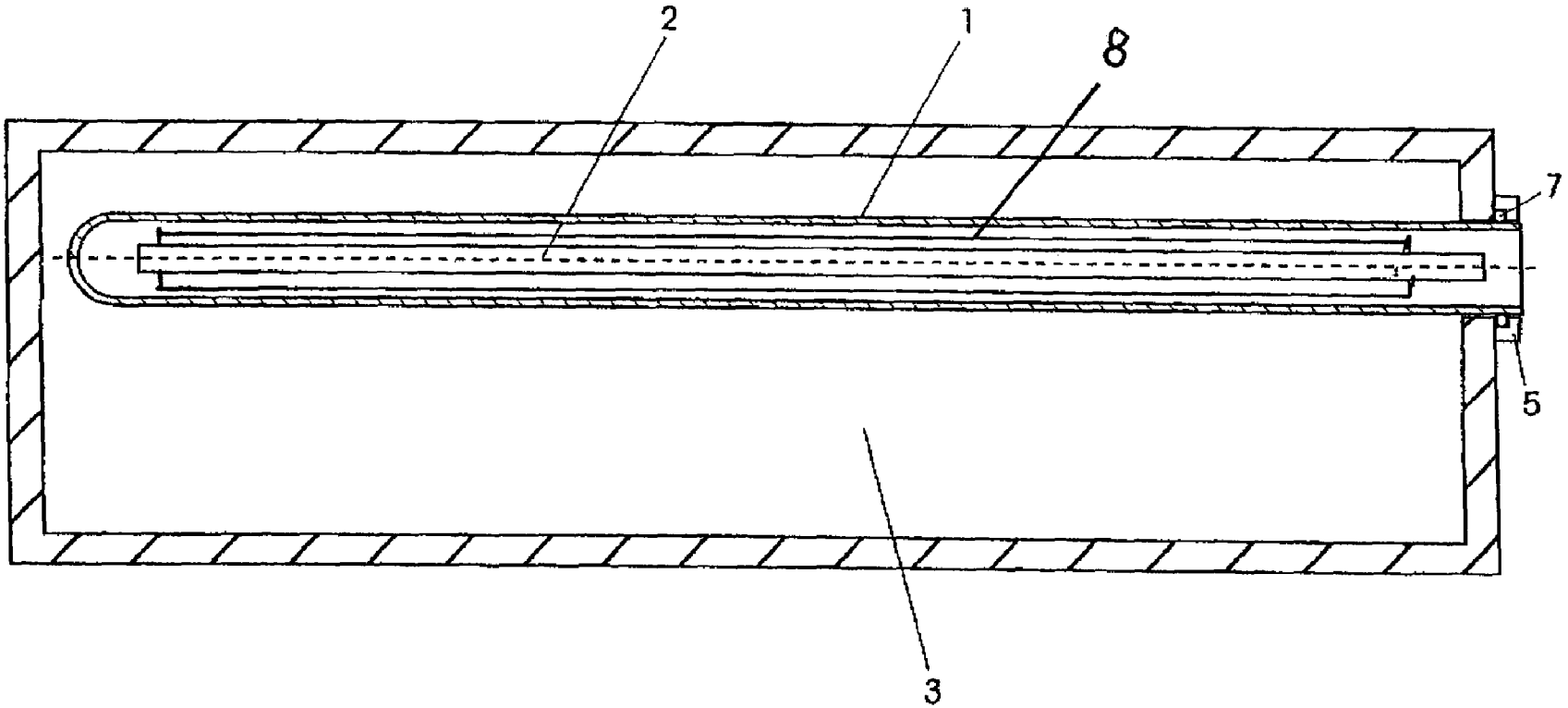
FIG. 2 shows a modification in which the tube transmissive to the infrared radiation is passed through only one wall, and the free end of the tube is closed inside the processing chamber.

FIG. 2 shows an embodiment in which the infrared-transmissive tube 1 is passed through only one wall 6, the free end of the tube 1 being closed inside the processing chamber 3. This modification can be implemented with less outlay, and offers the same advantages as the modification in which both ends of the tube 1 are passed through the wall 6 of the processing chamber. Also, an array of infrared radiation sources 2 can be achieved without problems, in which all the tubes 1 are passed through only one wall 6 of the processing chamber 3.

What is claimed is:

1. A radiant heating arrangement for a vacuum chamber having walls enclosing a chamber interior space to be heated, comprising a quartz glass tube transmissive to infrared radiation, said tube passing through a sealed opening in at least one of said chamber walls and having an interior portion within said chamber and at least one exterior opening through which cooling air can be supplied to the interior of said quartz glass tube, an infrared radiation source located within said interior portion of said tube, and a reflector located within said interior portion of said tube for directing said infrared radiation within said chamber toward objects to be heated.

2. A radiant heating arrangement as specified in claim 1 wherein there are provided a plurality of said tubes and a plurality of said infrared radiation sources located in each of said plurality of tubes.

3. A radiant heating arrangement as specified in claim 2 wherein said radiation sources are separately connectable to an energy source.

4. A radiant heating arrangement as specified in claim 1 wherein said tube passes through two of said chamber walls and includes two exterior openings.

* * * * *